US005309600A

United States Patent [19]

Weaver et al.

[11] Patent Number: 5,309,600

[45] Date of Patent: May 10, 1994

[54] VACUUM CLEANER WITH A DETACHABLE VACUUM MODULE

[75] Inventors: James M. Weaver; Giovanni Pino, both of Grand Rapids; Marc D. Zuiderveen, Hudsonville; Steven R. Umbach, East Grand Rapids, all of Mich.

[73] Assignee: Bissell Inc., Grand Rapids, Mich.

[21] Appl. No.: 17,652

[22] Filed: Feb. 12, 1993

[51] Int. Cl.[5] ..... A47L 7/00

[52] U.S. Cl. ..... 15/328; 15/323; 15/327.5; 15/329; 15/410

[58] Field of Search ..... 15/328, 329, 327.5

[56] References Cited

U.S. PATENT DOCUMENTS

| | | | |
|---|---|---|---|
| D. 278,560 | 4/1985 | Wareham . | |
| D. 307,657 | 5/1990 | Li . | |
| 1,944,950 | 1/1934 | Riebel, Jr. . | |
| 2,210,950 | 8/1940 | Replogle . | |
| 2,293,722 | 8/1942 | Erickson . | |
| 2,303,409 | 12/1942 | Taylor . | |
| 2,779,047 | 1/1957 | Osborn . | |
| 2,854,686 | 10/1958 | Hansen . | |
| 2,876,481 | 3/1959 | Gerber et al. . | |
| 2,898,621 | 8/1959 | Vance . | |
| 2,898,622 | 8/1959 | Hurd . | |
| 3,020,577 | 2/1962 | Carabet . | |
| 3,039,129 | 6/1962 | Belicka et al. . | |
| 3,039,130 | 6/1962 | Belicka et al. . | |
| 3,126,570 | 3/1964 | Green . | |
| 3,284,834 | 11/1966 | Waters . | |
| 3,310,828 | 3/1967 | Clark et al. . | |
| 3,509,590 | 5/1970 | Koshiyama . | |
| 3,758,914 | 9/1973 | Nupp et al. . | |
| 3,821,830 | 7/1974 | Sundheim . | |
| 3,869,265 | 3/1975 | Wolter et al. . | |
| 3,955,237 | 5/1976 | Chateauneuf et al. . | |
| 4,008,505 | 2/1977 | Clowers . | |
| 4,209,875 | 7/1980 | Pugh et al. . | |
| 4,249,280 | 2/1981 | Goodrich . | |
| 4,318,202 | 3/1982 | Holman | 15/328 |
| 4,393,536 | 7/1983 | Tapp . | |
| 4,421,964 | 12/1983 | Buchtel . | |
| 4,467,493 | 8/1984 | Buchtel . | |
| 4,519,113 | 5/1985 | Hipple . | |
| 4,545,089 | 10/1985 | Oxel . | |
| 4,635,315 | 1/1987 | Kozak . | |
| 4,660,246 | 4/1987 | Duncan et al. . | |
| 4,662,026 | 5/1987 | Sumerau et al. . | |
| 4,670,937 | 6/1987 | Sumerau et al. . | |
| 4,683,607 | 8/1987 | Lackner et al. . | |
| 4,763,382 | 8/1988 | Sumerau . | |
| 4,766,638 | 8/1988 | McDowell . | |
| 4,811,452 | 3/1989 | Sumerau . | |
| 4,947,512 | 8/1990 | Lackner et al. . | |
| 4,955,106 | 9/1990 | Stein et al. . | |
| 4,959,885 | 10/1990 | Sovis et al. . | |
| 5,007,133 | 4/1991 | Lackner et al. . | |
| 5,054,157 | 10/1991 | Werner et al. | 15/328 |
| 5,086,536 | 2/1992 | Lackner et al. . | |
| 5,228,169 | 7/1993 | Stein et al. . | |

FOREIGN PATENT DOCUMENTS

| | | | |
|---|---|---|---|
| 648771 | 8/1934 | Fed. Rep. of Germany | 15/328 |
| 1523210 | 5/1968 | France . | |
| 1052161 | 12/1966 | United Kingdom . | |
| 2254777 | 10/1992 | United Kingdom . | |

OTHER PUBLICATIONS

*Versamatic EC Brochure,* Windsor Industries, Inc., 1992.

Lindhaus U.S.A., "Lindhaus DP-5 Upright Carpet Vacuum", Jan. 1993.

*VDTA News,* "Lindhaus Opens North American Sales and Distribution Center", Jan. 1993.

Hoover Company, "Hoover Concept Two Self Propelled Cleaning System With Power Surge", Jan. 1987.

Unknown, "Hako Minuteman's 14", 2-Motor Patriot Upright Vacuum, prior to Aug. 5, 1992.

Stein & Co. relating to SEBO Automatic X1 Vacuum, Sep. 1992.

*Primary Examiner*—Chris K. Moore

*Attorney, Agent, or Firm*—Varnum, Riddering, Schmidt & Howlett

[57] ABSTRACT

A multi-use vacuum capable of use as an upright vacuum or as a canister vacuum is disclosed. A detachable vacuum module is selectively mounted to the foot and support member of an upright vacuum. The vacuum module includes the vacuum motor, motor-driven fan, vacuum bag and hose. The vacuum may be operated as an upright vacuum or, alternatively, the module can be separated from the foot and support member and may be used independently of and at a great distance from the foot and support member for a wide variety of cleaning purposes.

18 Claims, 7 Drawing Sheets

VACUUM CLEANER WITH A DETACHABLE VACUUM MODULE

BACKGROUND OF THE INVENTION

1. Field of the Invention

This invention relates to a multi-use vacuum cleaner, and, more particularly, to a vacuum cleaner having a vacuum module which is detachably mounted to a power foot and support member.

2. Description of Related Art

Historically, consumers have had the option of two different electrically powered vacuum cleaners. The first option was an upright vacuum cleaner comprising a cleaning foot upon which is pivotably mounted a handle supporting the vacuum motor and bag. An upright can be extremely effective in cleaning floors and carpet. However, an upright is not suitable for cleaning stairs, upholstery or drapery.

The second option for electric vacuums is a canister vacuum which typically comprises a canister housing the vacuum motor and bag. The canister is usually supported by casters. A long hose and wand are attached to an inlet of the canister. The wand can be attached to a cleaning foot or can be used with tools such as brushes or nozzles for cleaning hard-to-reach places such as stairs, upholstery, curtains and automobile interiors.

A recent trend in the vacuum cleaner industry has been to develop multi-use upright vacuum cleaners. These machines combine the compact structure and vertical orientation of an upright vacuum with the hose and wand features of a canister, thereby selectively providing the function of cleaning floors and/or alternatively cleaning drapes and upholstery within a short distance from the vacuum cleaner. Examples of this type of multi-use machine are disclosed in U.S. Pat. No. 4,955,106 to Stein et al., issued Sep. 11, 1990, U.S. Pat. No. 4,393,536 to Tapp, issued Jul. 19, 1983, U.S. Pat. No. 4,811,452 to Sumerau, issued Mar. 14, 1989, and U.S. Pat. No. 4,519,113 to Hipple, issued May 29, 1985.

A second multi-use vacuum disclosed in the prior art combines the features of a canister and an upright machine. The user must mount a baffle or other housing having a hose and wand extending therefrom to the bottom of the power foot of an upright vacuum. Examples are disclosed in U.S. Pat. No. 3,955,237 to Chateauneuf et al., issued May 11, 1976, and U.S. Pat. No. 4,008,505 to Clowers, issued Feb. 22, 1977.

Still yet another approach to expanding the applications of use for an upright vacuum is disclosed in U.S. Pat. No. 4,545,089 to Oxel, issued Oct. 8, 1985, and U.S. Pat. No. 4,467,493 to Buchtel, issued Aug. 28, 1984. In these references, a small hand-held vacuum is selectively mounted to an upright vacuum. The hand-held vacuum has its own motor and bag separate and distinct from the vacuum motor and bag of the upright. Thus, two vacuum cleaner units are provided in a single assembly.

Each of the several different prior multi-use upright vacuum cleaners suffers from one significant deficiency: namely, the ability to use and operate the detachable wand or hand held vacuum independently of or a significant distance from the body of the upright vacuum without providing a separate independent vacuum cleaner. For example, none of the prior multi-use vacuum cleaners can be effectively used for cleaning a flight of stairs. The known detachable wands are not long enough to span the entire length of a typical flight of stairs. Therefore, the user must carry the vacuum cleaner housing at least partially up the stairs. Moreover, most upright vacuum cleaners are wider than the average stairs. None of the wands are long enough to allow a user to easily clean a surface which is more than approximately eight feet from the body of the upright vacuum cleaner. Therefore, the known multi-use vacuum cleaners are not suitable for cleaning high surfaces where the machine can't reach.

SUMMARY OF INVENTION

The multi-use upright vacuum cleaner according to the invention overcomes these problems in the prior art with a separable vacuum module which can be used independently from and at any distance from the upright housing. A multi-use vacuum cleaner according to the invention combines, in a single unit, the desired ease of use, compact configuration and performance of an upright vacuum with the portability and multiple applications of a canister vacuum without requiring two vacuum motors and filter bags.

A vacuum cleaner according to the invention comprises a foot housing, a base pivotallymounted to the foot housing and an elongated support member nonremovably mounted at a lower portion to the base during typical use of the vacuum cleaner. The elongated support member is adapted for use in pushing and pulling the base and the foot housing along the floor. A portable cleaning module comprises a module housing, a bag supported in the module housing for collecting dust and dirt and a flexible conduit for conveying the collected dust and dirt from the foot housing to the bag. The conduit has a first end connected to the bag and a second end removably connected to the base. A motor driven fan is supported in the module housing for creating suction within the conduit through the bag to convey collected dust and dirt to the bag. The module mounts the bag, conduit and motor-driven fan such that the bag, conduit and motor-driven fan are connected together as a unit. The module is selectively and removably mounted to the base at least through a mechanical interconnection such that the module can be separated from the foot housing, base and elongated support member and be operated as a portable vacuum cleaner. The module is closely adjacent the elongated support member, extends upwardly along at least a portion of the length of the elongated support member relative to the foot housing when the module is mounted to the base. With this configuration, the module can be operated as a portable vacuum cleaner independently of and separate from the foot housing, base and elongated support member when the module is separated from the base and the vacuum cleaner can be operated as an upright vacuum cleaner when the module is mounted to the base.

In one embodiment, the module is interconnected to the floor suction component by a male connector formed on one of the module housing and the floor suction component and a female connector formed on the other of the module and the floor suction component.

In another embodiment, a first electrical connector is mounted to the module housing for supplying electrical current to the motor and a second electrical connector is formed on the floor suction component. The first and second electrical connectors are selectively engaged when the housing is mounted to the floor suction component to supply electrical current from the module to the floor suction component.

In yet another embodiment, the conduit comprises a flexible hose and a wand where the distal end of the flexible hose is connected to the bag and a proximal end of the hose is in fluid communication with the wand. Preferably, a handle formed on the wand is received in a complementary recess formed on the side of the module housing. The wand is mounted to the module housing when it is received in the complementary recess. In this condition, the wand is connected to the floor suction component. The wand can be removed from the complementary recess and the module housing can be used for diverse cleaning applications.

BRIEF DESCRIPTION OF THE DRAWINGS

The invention will now be described with reference to the drawings wherein.

DESCRIPTION OF THE PREFERRED EMBODIMENTS

Figure 1:
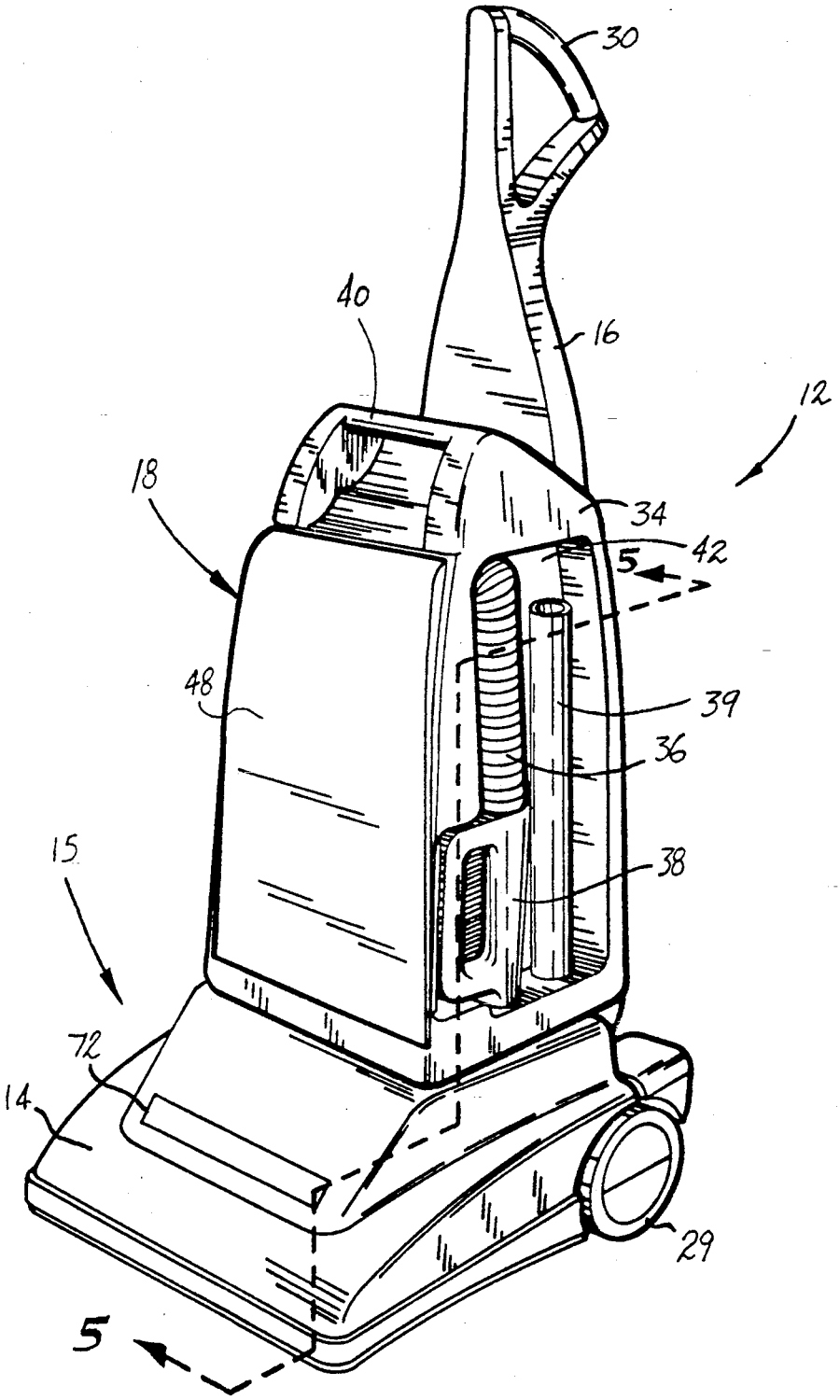
FIG. 1 is a perspective view of an upright vacuum incorporating a detachable vacuum module according to the invention.
Figure 5:
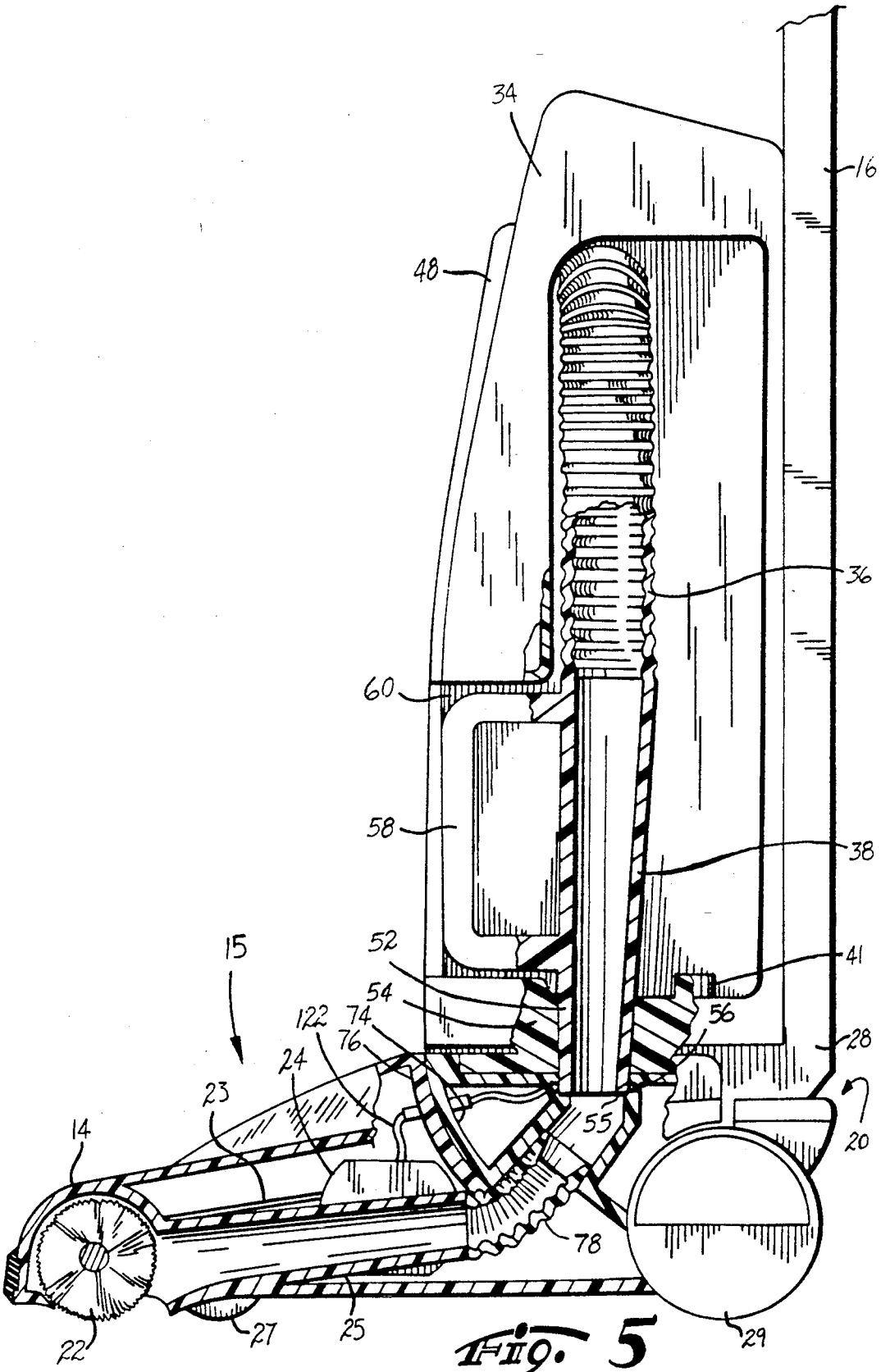
FIG. 5 is a partial sectional side view of the vacuum according to the invention taken along lines 5—5 of FIG. 1.
Figure 6:
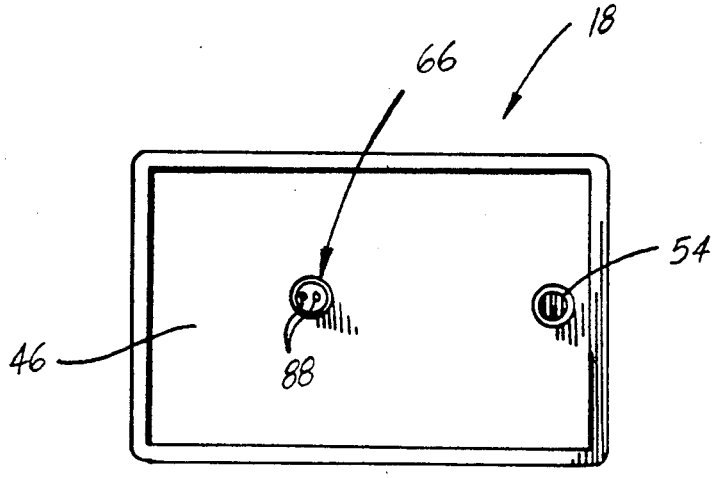
FIG. 6 is a bottom view of the detachable module.
Figure 7:
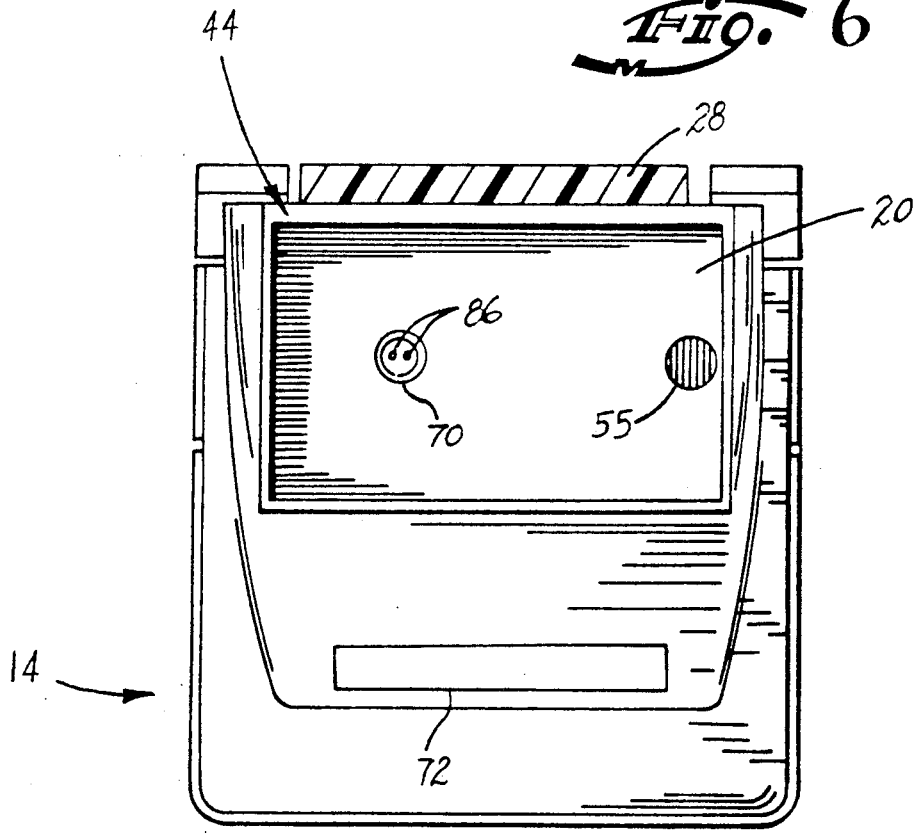
FIG. 7 is a sectional view of the upright housing taken along lines 7—7 of FIG. 2 and top view of the floor suction component according to the invention.

Referring now to the drawings, FIGS. 1 and 5 disclose a multi-use vacuum which can be used in a conventional manner as an upright vacuum or can be used as an upright vacuum with detachable wand for above-floor cleaning, a portable vacuum, a hand-held vacuum, or a canister vacuum. The multi-use vacuum 12 comprises floor suction component 15, a support member 16 pivotally mounted to the floor suction component 15 and a vacuum module 18 mounted to the floor suction component 15. The floor suction component 15 comprises a foot 14 and a base 20 pivotably mounted within the foot 14. As seen in FIG. 5, the foot 14 is conventional in design and houses an agitation member or rotating brush 22, brush motor 24 for imparting rotation to the brush 22, a belt 23 interconnecting the motor 24 and the brush 22 and a nozzle 25 for collecting and conveying the collected dirt and dust. The foot 14 is supported by a pair of front wheels 27 and a pair of rear wheels 29 for rolling movement along the floor.

The distal end 28 of the support member 16 is mounted to the rotating base 20. The proximal end 26 of the support member 16 has a grip 30 mounted thereto. The user grasps the grip 30 when using the multi-use vacuum 12 in the upright mode.

Figure 2:
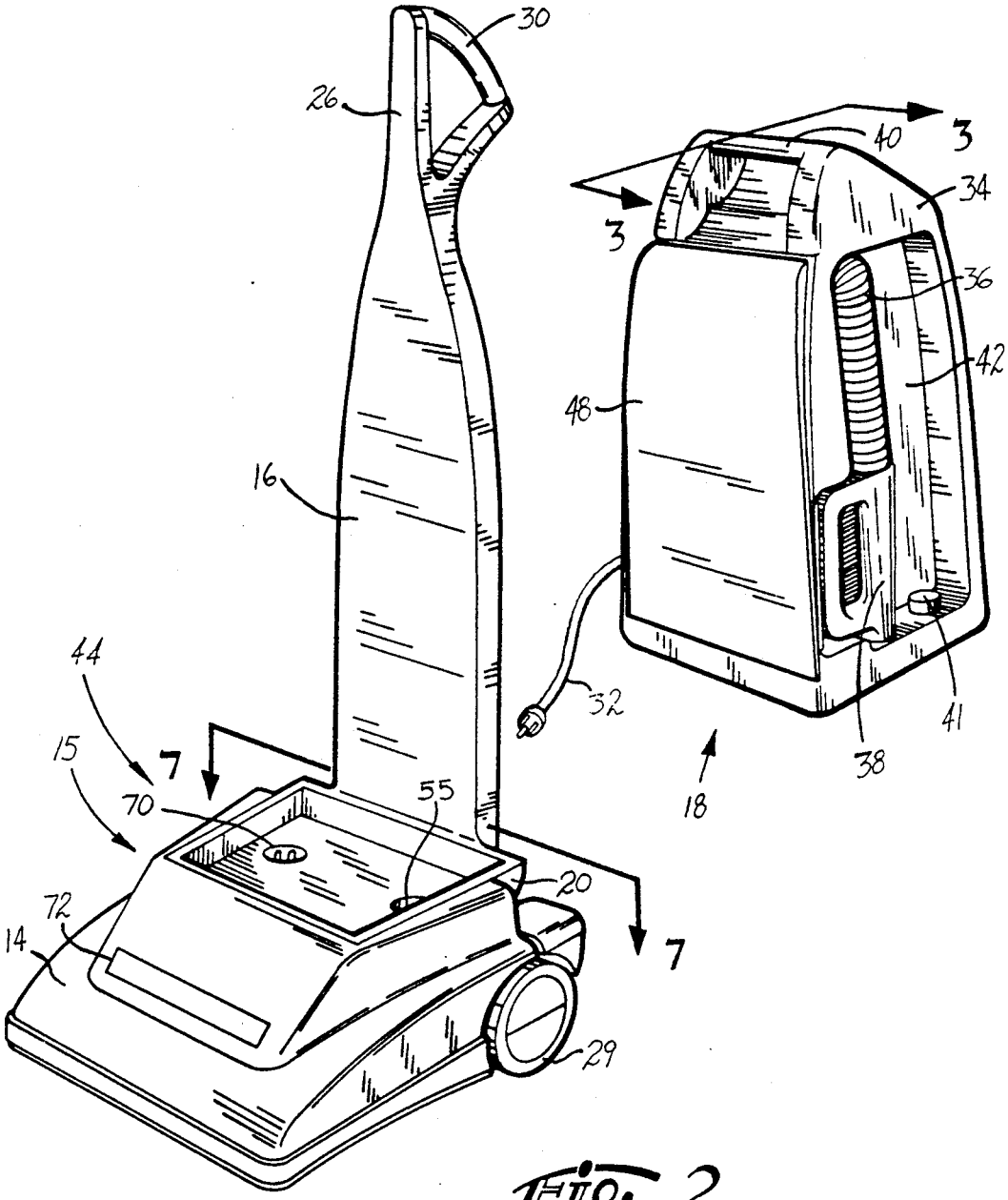
FIG. 2 is a perspective view of the vacuum of FIG. 1 with the vacuum module separated from the upright vacuum housing.
Figure 3:
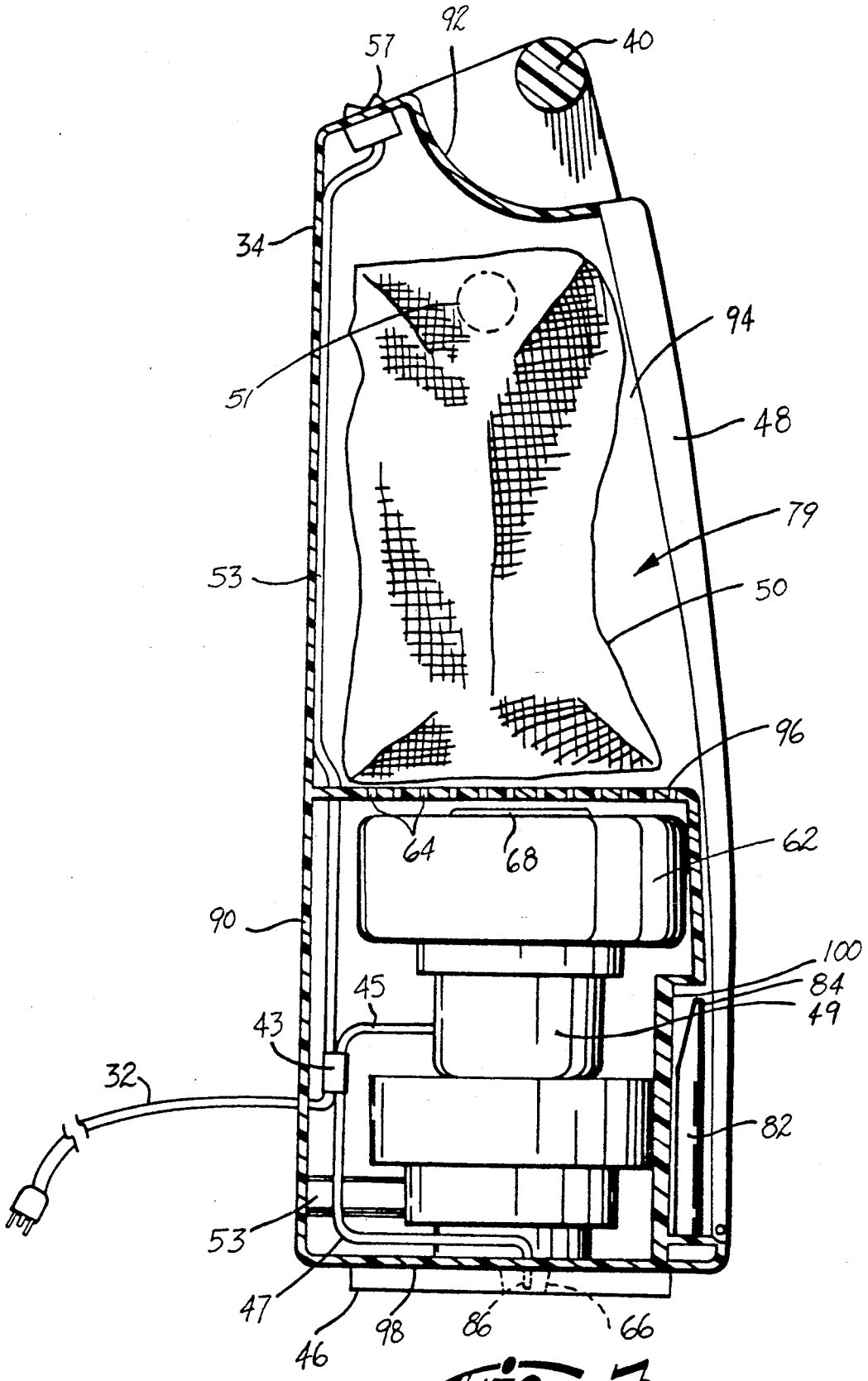
FIG. 3 is a sectional view of the vacuum module according to the invention taken along lines 3-3 of FIG. 2.

As seen in FIGS. 2 and 3, the vacuum module 18 comprises a housing 34 and a conduit comprising a flexible hose 36 and a wand 38. The hose 36 and wand 38 are selectively received within a recess 42 formed on the side of the housing 34 of the vacuum module 18. A wand extension 39 and accessory tools such as brushes and crevice tool nozzles (not shown) are selectively mounted in the recess 42. The tubular bodies of the wand extension 39 or other accessories are received on a mounting protection 41 (FIG. 2) formed within the recess 42 for mounting thereto. A module handle 40 is mounted to the top of the vacuum module 18 which can be grasped by the user when operating the module independently of the foot 14 and support member 16. While the conduit and accessory tools of the preferred embodiment are mounted in a recess 42 on the side of the module housing 34, it is understood that these elements could also be mounted in a recess formed on the back of the vacuum module housing 34.

As seen in FIGS. 2 and 3, the vacuum module 18 is selectively mounted to the rotating base 20 to supply electrical current and air suction to the base and foot 14 by a pair of connectors. A rim 44 forms a female connector on the top surface of the base 20 and a projection 46 forms a complementary male connector on the module 18. The rim 44 and cooperating projection 46 on the bottom surface of the housing 34 provide a releasable mechanical interconnection between the vacuum module 18 and the floor suction component 15. The module 18 is adapted to operate independently from the body of the upright vacuum, namely, the floor suction component 15 and support member 16. The releasable interconnection of the module 18 with the base 20 results in easy removal and replacement of the module 18 from the base 20. No tools or great amount of effort is required to disengage the module 18 from the base 20. The user merely lifts up the module 18 relative to the base 20. To replace the module 18, the user merely aligns the rim 44 and projection 46 and lowers the module 18 back onto the base 20.

Electrical current is supplied to the vacuum module 18 from a conventional outlet via an electrical cord 32 of the vacuum module 18. The cord 32 is electrically connected to a conventional crimp nut 43 inside the housing 34. A first electrical conduit 45 electrically interconnects the crimp nut 43 and the vacuum motor 49. A second electrical conduit 47 electrically interconnects the electrical connector 66 of the module, described further below, with the crimp nut 43 and a third electrical conduit 53 electrically interconnects the on/-off toggle switch 57 to the crimp nut 43. The cord 32 supplies all of the electrical current necessary to operate the unit as an upright vacuum cleaner, an above the floor upright, or a portable module. In addition, the cord 32 is in no way connected to the body of the upright vacuum to inhibit the use of the module 18 an unlimited distance from the body of the upright vacuum.

As seen in FIG. 3, the vacuum module 18 houses a vacuum motor 49 which drives a bypass vacuum fan 62 which pulls air through a filter bag 50. An alternative to a permeable bag would be a cup or other container as a repository for collected dirt and dust. An access panel 48 is pivotally mounted to the front of the housing 34 of the vacuum module 18 for accessing bag 50. In addition, accessory tools such as a crevice tool nozzle 82 may be stored in a recess 84 behind the access panel 48.

The vacuum motor 49 arrangement of the preferred embodiment is a "clean air" vacuum motor. The permeable vacuum bag 50 is mounted within a first or bag chamber 79 within the module while the motor is mounted in a second or motor chamber 80 within the module 18. The bag chamber 79 is defined by the access panel 48, the rear wall 90 of the module, the top wall 92 of the module, the side walls 94 of the module, and an intermediate wall 96 which separates the bag chamber 79 from the motor chamber 80. The motor chamber 80 is defined by the intermediate wall 96, the rear wall of the module 90, the side walls 94 of the module, the bottom wall 98 of the module, and a protective wall 100 mounted along the front of the motor chamber 80. The protective wall 100 conceals the motor 49 and fan 62 from view and prevents access thereto by a user When the access panel 48 is open. The motor 49 draws in air from the bag chamber 79 through a grate 64 formed in the intermediate wall 96 and expels it out of the housing 34 through an exhaust 53, thereby creating an environment of lower air pressure within the bag chamber 79 of the housing 34. Air is drawn into the bag chamber of the housing 34 through an inlet 51 to which the hose 36 and wand 38 are mounted. Dirt and dust collected by the module 18 pass through the wand 38, the hose 36 and the inlet 51 and are deposited in the bag 50. Preferably, a filter 68 is mounted to the fan 62 to prevent large particles of dirt from entering the motor 49.

Figure 4:
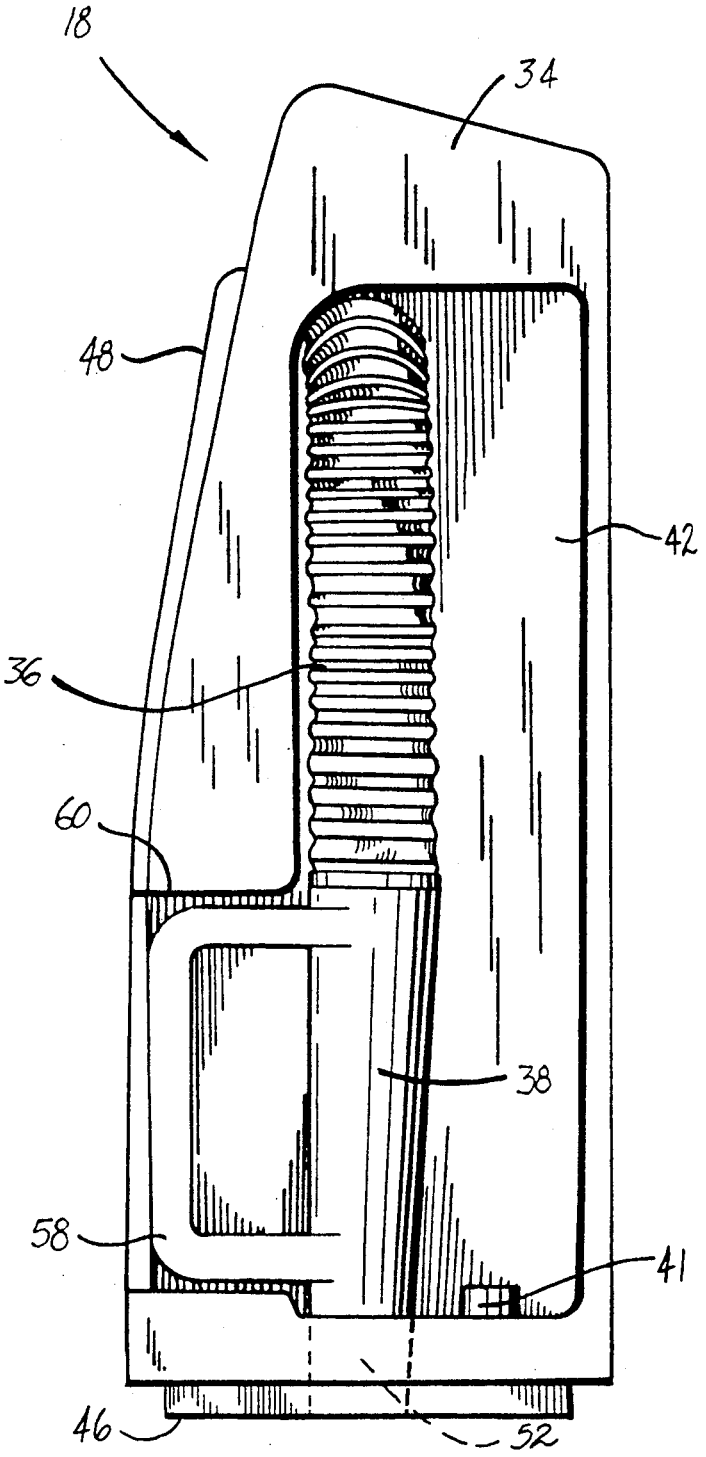
FIG. 4 is a right side elevational view of the vacuum module according to the invention.

The wand 38 and hose 36 are selectively mounted within the module housing 34 to permit use of the wand 38 and tools mounted thereto for a wide variety of cleaning applications with the module 18 mounted to the upright vacuum body or separate therefrom. As seen in FIGS. 4 and 5, a distal end 52 of the wand 38 is received in an opening 54 of the module 18. In the preferred embodiment, the distal end 52 of the wand 38 engages the top 55 of the nozzle 25 in the rotating base 20. Therefore, any dirt and dust collected by the brush 22 passes through the nozzle 25, the wand 38, the hose 36 and ultimately is deposited in the bag 50. Preferably, a seal 56, such as an O-ring, is mounted to the top 55 of the nozzle 25 for a substantially airtight engagement of the distal end 52 of the wand 38 with the foot 14. Alternatives to the O-ring include an interference fit between the distal end 52 of the wand and the foot or a plastic or rubber boot mounted in the base 20 to engage the distal end 52 of the wand.

For operation of the multi-use vacuum 12 as an upright, the wand 38 is locked into engagement with the nozzle 25 of the floor suction component 15 through the unique configuration of the wand 38 and the recess 42. As seen in FIGS. 4 and 5, the wand has a C-shaped handle 58 and the recess 42 has a second recess or interlocking portion 60 which is complementary in shape to the outside perimeter of the handle 58. In use as an upright vacuum, the wand 38 is rotated so that the handle 58 is received in the interlocking portion 60 and the distal end 52 of the wand 38 is received in the wand opening 54 of the module 18. The wand 38 is removed from interlocking engagement with the module 18 by first rotating the wand 38 and handle 58 out of engagement with the interlocking portion 60 of the recess 42. Then, the wand 38 is raised to remove the distal end 52 of the wand 38 from the wand opening 54. With the wand 38 removed from interlocking engagement with the module 18, the wand 38 and accessory tools may be used for a wide variety of cleaning purposes with the vacuum still in the upright configuration for traditional above the floor cleaning. An alternative to the interlocking recess and handle configuration would be an air-tight interference fit between the wand and the top of the nozzle 25.

As seen in FIGS. 2, 5, 6 and 7, the male connector 46 of the vacuum module extends downwardly from the module 18 and is received within the complimentary female connector 44 of the rotating base 20. As noted above, the distal end 52 of the wand 38 extends through the wand opening 54 of the module 18 to engage the top 55 of the nozzle 25 when the module 18 is mounted to the rotating base 20. Similarly, an electrical connector 66 formed on the bottom of the module 18 engages a corresponding electrical connector 70 of the base 20 to supply electrical current to the foot 14. The electrical current is necessary for the operation of the brush motor 24 and a light 72 mounted in the foot 14. Preferably, the electrical connector 66 formed on the bottom of the module is a female connector and the connector 70 formed on the top of the rotating base 20 is a male connector. The upstanding prongs 86 of the male connector 70 engage complementary recesses 88 formed in the female connector 66.

As seen in FIG. 5, the leading edge 74 of the base 20 is arcuate and abuts a complementary arcuate mounting surface 76 of the foot 14. The leading edge 74 of the base bears against the mounting surface 76 to permit pivoting rotation of the base 20, module 18 and support member 16 relative to the foot 14. The nozzle 25 has a flexible portion 78 formed at the juncture between the leading edge 74 and mounting surface 76. This flexible portion 78 permits the pivotal movement of the base 20 relative to the foot 14 while maintaining the air tight integrity of the nozzle 25. An alternative to the complementary arcuate surfaces of the base 20 and foot 14, would be to use a rotating axle mounted in the foot 14 to support the base 20.

Figure 8:
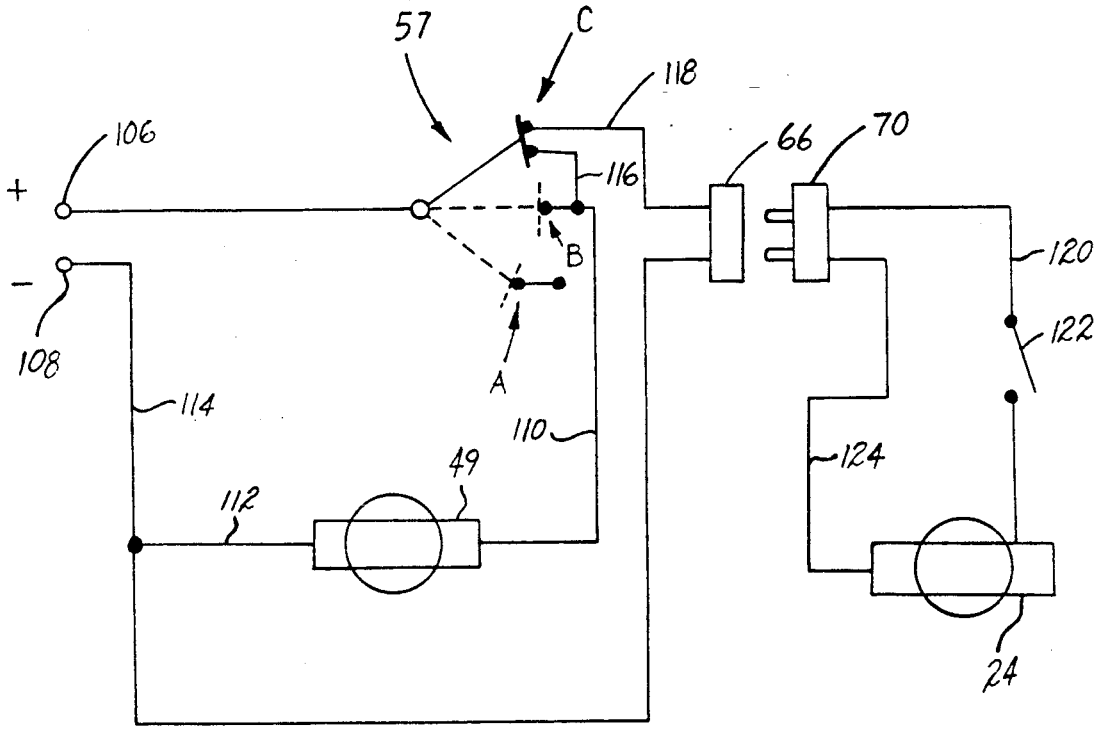
FIG. 8 is a schematic diagram of the electrical system used in the vacuum cleaner according to the invention.

The electrical schematic diagram of the vacuum cleaner according to the invention is seen in FIG. 8. The on/off toggle switch 57 mounted to the top wall 92 of the module is selectively received in one of three positions. In the first position or off position, A, there is an open electrical circuit within the vacuum unit. Therefore, no current is supplied to either the vacuum motor 49 or the brush motor 24. In the second position, B, an electrical circuit is completed between the positive terminal 106 and the negative terminal 108 through the vacuum motor 49 and the toggle switch 57. In the B position, electrical current flows from the positive terminal 106, through the switch 57, through a first electrical lead line 110 to the vacuum motor 49. The current further flows from the vacuum motor 49 through a second electrical lead line 112 to a return conduit 114, thereby completing the electrical circuit.

In the C position, it is possible to supply electrical current to both the vacuum motor 49 and the brush motor 24. The current flows from the positive terminal 106 through the switch 57, through a third electrical lead line 116 to the first electrical lead line 110. The electrical circuit for the vacuum motor 49 is completed as previously described. The switch 57 in the C position also conducts electrical current through a fourth electrical lead line 118 to the female converter 66. If the female converter 66 is coupled to the male connector 70, then the electrical current will flow to a micro switch 122 through a conduit 120.

As seen in FIG. 5, a micro switch 122 is mounted along the interface between the foot 14 and the rotatable base 20. The micro switch 122 is constructed such that when the support member 16 is rotated to the fully upright position, the switch 122 will break the electrical circuit supplying current to the brush motor 24. When the user pivots the support member 16 downwardly from the fully upright position, then the switch 122 switches to its second or closed position thereby completing the electrical circuit to the brush motor 24. An electrical lead line 124 interconnects the brush motor 24 with the negative terminal of the electrical connector 70 of the foot. The negative terminal of the electrical connector 66 of the module is connected to the return lead line 114.

The multi-use vacuum according to the invention is adaptable for a wide variety of different cleaning applications. For use as an upright vacuum, the user grasps the grip 30 of the support member and rolls the upright vacuum 12 across the surface to be cleaned. The motor 49 within the module 18 supplies the suction to the foot 14. The collected dirt and dust are deposited in the vacuum bag 50 of the module 18.

As noted above, the wand 38 can be easily disengaged from the floor suction component 15 to clean upholstery or other surfaces within relatively close proximity to the body of the upright vacuum. However, when the wand 38 is to be used for cleaning a surface which cannot be easily accessed with the module 18 mounted to the base 20, the module 18 can be easily separated from the body of the upright vacuum. The module 18 is detached by grasping the module handle 40 and lifting upwardly. The electrical connectors 66, 70 disengage, thereby discontinuing the supply of electrical current to the foot. Similarly, the supply of vacuum pressure to the floor suction component 15 is discontinued by the removal of the wand 38 from engagement with the top 55 of the nozzle 25. Accessories such as the wand extension 39, concentrator nozzles and brushes can be selectively mounted to the end of the wand 38 for different applications. These accessories can be carried by the module or can be carried separately. Preferably, the hose 36 is expandable in length and flexible allowing the user to easily manipulate the hose and any tools attached thereto to suit a wide variety of cleaning applications.

Through the use of the module handle 40 the user can easily carry the vacuum module 18 to any location for use independent from and at an unlimited distance from the body of the upright vacuum. For example, the user can vacuum a stairway and easily carry the module with him or place the module 18 on the stairs while he works. Alternatively, the user can carry the module up a step ladder to clean hard to reach surfaces such as shelves, bookcases and draperies. The module 18 can be further modified by mounting casters to the module for rolling along a floor or other surface.

As discussed above, the multi-use vacuum according to the invention provides a significant improvement over the known multi-use vacuums. Namely, the vacuum provides the ease of use and performance of an upright vacuum for cleaning floor surfaces and the adaptability of a wand and hose mounted to the upright for cleaning articles within a limited distance of the body of the upright vacuum. More importantly, the detachable module allows the use of the vacuum in less accessible places such as car interiors, stairwells and other hard to reach surfaces. Even with all of these diverse applications, the multi-use vacuum utilizes only one vacuum motor and one vacuum bag. A user can now purchase a single multi-use vacuum according to the invention and obtain all of the benefits of an upright vacuum in a small, portable canister vacuum.

Whereas the invention has been described with respect to mounting the vacuum module 18 to a rotating base 20 which rotates with the support 16, it is within the scope of the invention to mount the module 18 to a base which is non-rotatably mounted to the floor suction component 15. In this case, the support 16 would rotate separately from the module 18. The invention has also been described with reference to a suction unit in which the dirty air is drawn through a filter bag. It is also within the scope of the invention to provide a filter bag downstream of a fan or impeller so that dirty air is forced through rather than drawn through a filter bag.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. A vacuum cleaner comprising;

a foot housing;

a base pivotally mounted to said foot housing;

an elongated support member non-removably mounted at a lower portion to the base during typical use of the vacuum cleaner, the elongated support member being adapted for use in pushing and pulling the base and the foot housing along the floor; and a portable cleaning module comprising;

a module housing;

a bag supported in the module housing for collecting dust and dirt;

a flexible conduit for conveying the collected dust and dirt from the foot housing to the bag, the conduit having a first end connected to the bag and a second end removably connected to the base; and a motor-driven fan supported in the module housing for creating suction within the conduit through the bag to convey collected dust and dirt to the bag;

the module mounting the bag, conduit and motor-driven fan such that the bag, conduit and motor-driven fan are connected together as a unit, the module being selectively and removably mounted to the base at least through a mechanical interconnection such that the module can be separated from the foot housing, base and elongated support member and be operated as a portable vacuum cleaner and the module further is closely adjacent the elongated support member, extends upwardly along at least a portion of the length of the elongated support member and is adapted to pivot with the base and elongated support member relative the foot housing when the module is mounted to the base;

whereby the module can be operated as a portable vacuum cleaner independently of and separate from the foot housing, base and elongated support member when the module is separated from the base and the vacuum cleaner can be operated as an upright vacuum cleaner when the module is mounted to the base.

2. A vacuum cleaner according to claim 1 wherein the interconnection between the module housing and the base comprises a male connector formed on one of the base and the module housing and a female connector formed on the other of the base and the module housing.

3. A vacuum cleaner according to claim 2 wherein the interconnection between the module housing and the base further comprises a first electrical connector formed on one of the base and module housing and a second electrical connector formed on the other of the base and module housing, the first and second electrical connectors being selectively engaged to supply electrical current from the module to the foot housing when the module housing is mounted to the base.

4. A vacuum cleaner according to claim 3 wherein the conduit comprises a wand which is removably mounted in the module housing and connected to said base when the wand is mounted in the module housing and the module housing is mounted to the base.

5. A vacuum cleaner according to claim 1 wherein the interconnection between the module housing and the base comprises a male connector formed on one of the base and the module housing and a female connector formed on the other of the base and the module housing.

6. A vacuum cleaner according to claim 5 and further comprising a first electrical connector formed on one of the base and module housing and a second electrical connector formed on the other of the base and module housing, the first and second electrical connectors being selectively engaged to supply electrical current from the module to the foot housing.

7. A vacuum cleaner according to claim 1 wherein the conduit comprises a flexible hose and a wand, a distal end of the flexible hose being in fluid communication with the bag and a proximal end of the hose being in fluid communication with the wand and the wand is removably mounted to the module housing.

8. A vacuum cleaner according to claim 7 and further comprising a first recess formed on one side of the module housing for storing the wand and hose.

9. A vacuum cleaner according to claim 7 and further comprising a handle mounted to the wand and a second recess formed in a side of the module housing, the second recess being complementary in shape to the outside perimeter of the handle so that the wand is selectively mounted in the module housing through the interengagement of the handle and the second recess.

10. A vacuum cleaner according to claim 1 and further comprising an agitation member and an agitation member motor mounted in the floor suction component.

11. A vacuum cleaner according to claim 1 and further comprising an electrical cord electrically connected to the module, the cord supplying all of the electrical current necessary to operate the vacuum cleaner as an upright vacuum cleaner or to operate the module independently of the floor suction component and support member.

12. A vacuum cleaner according to claim 1 and further comprising a switch mounted to one of the base and the support member, the switch having first and second operable positions, wherein the switch is adapted to assume the first position when the support member is in a fully upright position relative to the foot housing and the switch is adapted to assume the second position when the support member is in a position other than the fully upright position relative to the foot housing, wherein in the first position, the switch prevents the flow of electrical current to an agitation motor mounted in the foot housing and in the second position, the switch completes and electrical circuit to supply electrical current to the agitation motor.

13. A vacuum cleaner according to claim 1 wherein the conduit comprises a wand which is removably mounted in the module housing and connected to said base when the wand is mounted in the module housing and the module housing is mounted to the base.

14. A vacuum module for selectively mounting to a floor suction component, the module comprising;

a motor, a fan coupled to the motor to draw a suction, a conduit and a bag interconnected as a single unit, the module having a housing to support the motor and bag and the conduit being mounted at one end to the bag and comprising a wand and a hose;

the housing comprises an external mechanical connector for mechanically connecting the module to a floor suction component, an external coupler associated with the mechanical coupler, to couple the fan inlet to the floor suction component, a first recess formed on one side of the module housing for receiving the wand and hose, and a handle mounted to an upper portion of the housing;

whereby the module is adapted to selectively engage the floor suction component and to provide the suction necessary to operate the module and floor suction component as an upright vacuum, and the module is further adapted to operate independently of and separate from the floor suction component.

15. A vacuum module according to claim 14 further comprising a handle mounted to the wand and a second recess formed in a side of the module housing, the second recess being complementary in shape to the outside perimeter of the handle so that the wand is selectively mounted in the module housing through the interengagement of the handle and the second recess.

16. A vacuum module according to claim 15 wherein the handle is C-shaped.

17. A vacuum module according to claim 14 and further comprising an electrical cord electrically connected to the module, and an external electrical coupler mounted on the module housing in association with the external mechanical connector and connected to the electrical cord for supplying electrical current to the base, whereby the electrical cord can supply the electrical current necessary to operate the vacuum cleaner as an upright vacuum cleaner or to operate the module independently of the base, support member and foot housing.

18. A vacuum cleaner according to claim 1 and further comprising a handle mounted to the top of the portable cleaning module, the handle being adapted to be grasped by the user when the portable cleaning module is separated form the base, foot housing and elongated support member.

* * * * *

UNITED STATES PATENT AND TRADEMARK OFFICE

CERTIFICATE OF CORRECTION

PATENT NO. : 5,309,600

DATED : May 10, 1994

INVENTOR(S) : Weaver et al.

It is certified that error appears in the above-identified patent and that said Letters Patent is hereby corrected as shown below:

Col. 10, claim 12, line 9 "and" should be --an--.

Col. 10, claim 18, line 62 "form" should be --from--.

Signed and Sealed this

Eighteenth Day of October, 1994

*Attest:*

Bruce Lehman

BRUCE LEHMAN

*Attesting Officer*

*Commissioner of Patents and Trademarks*